US007117670B2

(12) United States Patent
Kühn

(10) Patent No.: US 7,117,670 B2
(45) Date of Patent: Oct. 10, 2006

(54) CONTROL DEVICE

(75) Inventor: Michael Kühn, Wotenitz (DE)

(73) Assignee: Hydac Technology GmbH, Sulzbach/Saar (DE)

( * ) Notice: Subject to any disclaimer, the term of this patent is extended or adjusted under 35 U.S.C. 154(b) by 0 days.

(21) Appl. No.: 10/476,071

(22) PCT Filed: Jun. 27, 2002

(86) PCT No.: PCT/EP02/07090

§ 371 (c)(1),
(2), (4) Date: Oct. 28, 2003

(87) PCT Pub. No.: WO03/031734

PCT Pub. Date: Apr. 17, 2003

(65) Prior Publication Data

US 2004/0134191 A1 Jul. 15, 2004

(30) Foreign Application Priority Data

Oct. 4, 2001 (DE) ..... 101 48 962

(51) Int. Cl.
*F16D 31/02* (2006.01)

(52) U.S. Cl. ..... 60/469

(58) Field of Classification Search ..... 60/469, 60/413, 414

See application file for complete search history.

(56) References Cited

U.S. PATENT DOCUMENTS 5,195,864 A * 3/1993 Drake et al. ..... 60/469

FOREIGN PATENT DOCUMENTS

| | | |
|---|---|---|
| DE | 3909205 | 5/1990 |
| DE | 4129509 | 6/1994 |
| EP | 0266785 | 11/1988 |
| JP | 08277548 | 10/1996 |
| JP | 09078633 | 3/1997 |
| JP | 11036375 | 2/1999 |

* cited by examiner

*Primary Examiner*—F. Daniel Lopez
(74) *Attorney, Agent, or Firm*—Roylance, Abrams, Berdo & Goodman, L.L.P.

(57) ABSTRACT

A control device, in particular for working machines, such as wheel loaders, excavators or similar devices, includes at least one working tool (12), particularly a working shovel that can be actuated by at least one hydraulic working cylinder (10). The device has a control block for controlling the hydraulic fluid paths between the working cylinder (10), a hydraulic fluid supply (P) and a tank (T). The device also has at least one hydraulic accumulator (22) and a shut-off or stop valve (32). The shut-off valve has a controllable valve member (34) and is located between the working cylinder (10) and the accumulator (22). The valve member is connected in the transmission position for connecting the accumulator (22) in order to damp the motion of the working cylinder (10). A selector valve (26) that can be controlled by the control block (20) is connected in the feed line (24), blocking the line (24) in the non-actuated state. The shut-off valve (32) is connected in a secondary line (30) that is connected to the feed line (24), The shut-off valve is impinged in the open direction by accumulator pressure, and is decompressed in the closed direction. This permits increased safety to be achieved for working machines, and prevents an excess load from being placed on the damping accumulator.

7 Claims, 1 Drawing Sheet

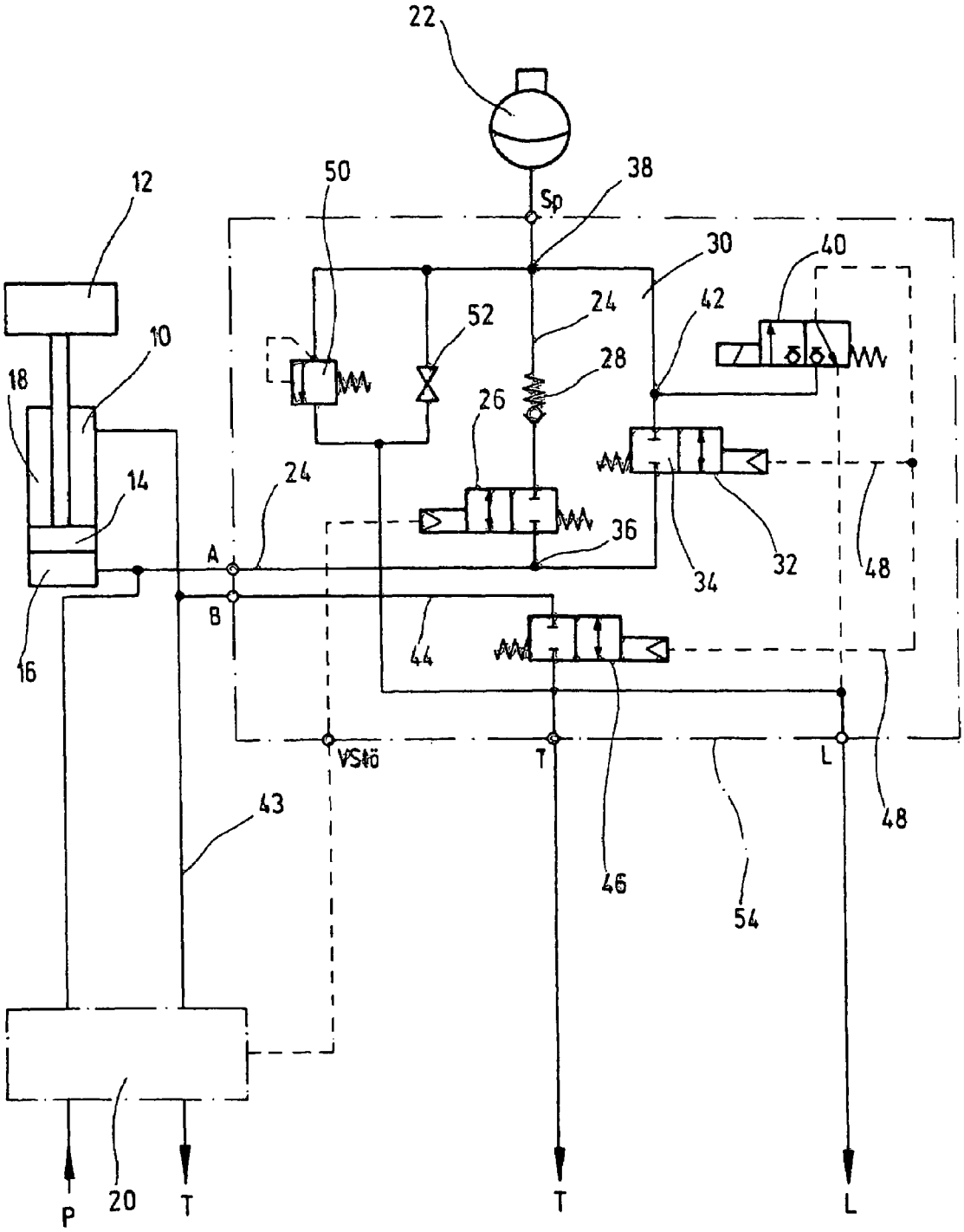
22
12
50
38
Sp
30
40
24
42
52
10
28
18
26
14
24
36
A
34
32
48
B
44
16
VStö
T
L
43
48
46
54
P
20
T
T
L

CONTROL DEVICE

FIELD OF THE INVENTION

The present invention relates to a control device, in particular for machines such as wheeled loaders, excavators, or the like having at least one operating implement, a tractor loader in particular. The operating implement is actuatable by at least one hydraulic operating cylinder. A control block controls the pressure medium paths between operating cylinder, a pressure medium supply, and a tank. At least one hydraulic accumulator is in fluid communication with the operating cylinder, with a stop valve mounted between the operating cylinder and the accumulator. The stop valve has an actuatable valve element which is switched to its conducting position by operating cylinder to connect the accumulator for the purpose of cushioning a load.

BACKGROUND OF THE INVENTION

In a control device as disclosed in DE 41 29 509 C2, the hydraulic accumulator may be connected to the pressure medium source by a feed line. A stop valve operates between the operating cylinder and the accumulator, and is mounted directly in the feed line itself. The valve element of the stop valve has accumulator pressure applied to it in the direction of closing, and is relieved of pressure in the direction of opening.

In the disclosed system, the respective hydraulic accumulator is charged during raising of the load by the respective operating cylinder.

If the accumulator pressure rises to a value corresponding to the load pressure, a special seat valve intended for the purpose closes. The control compartment space of this seat valve is being charged with pressure. For connecting the respective hydraulic suspension accumulator to the respective operating cylinder, a three-way valve is automatically reversed. This process can take place automatically. The accumulator pressure then equals the load pressure on the piston side of the respective operating cylinder, since the hydraulic damping accumulator has been charged to this pressure by way of the feed line. The damping accordingly takes place at the pressure predominating in the piston space of the respective operating cylinder, not at a higher or lower pressure, which would additionally result in undesirable movement of the piston of the operating cylinder. Sagging of the load on connection of the respective hydraulic damping accumulator in particular is prevented. If, however, dynamic loads are applied to the hydraulic operating cylinder, ones in the form of peak loads, for example, which may occur when the operating machine in the form of a wheeled loader runs into material to be loaded, such as broken stones, soil, or the like, these peak loads damaging the damping accumulator are transmitted directly to the latter.

To prevent this occurrence, DE 39 09 205 C1 discloses, a conventional hydraulic system for construction machines such as wheeled loaders, tractors, or the like, a connecting line, branched off inside a main line leading to the hydraulic operating cylinders and provided with a stop valve. The stop valve is then bridged by the feed line, which in turn has a pressure reduction valve. The disclosed configuration allows charging the respective hydraulic accumulator during raising of the load by the respective hydraulic cylinder, specifically with a higher pressure determined by the pressure reduction valve. However, when the damping accumulator is connected by the stop valve to the piston side of the respective operating cylinder, the pressure on the piston side does not necessarily correspond to the higher damping pressure on the accumulator side, so that extension movement may unintentionally be transmitted to the operating cylinders and accordingly to the loading shovel.

U.S. Pat. No. 5,733,095 discloses a generic machine with a control device having at least one operating implement actuatable by at least one hydraulic operating cylinder, having a control block for control of the pressure medium paths between the operating cylinder, a pressure medium supply, and a tank, having at least one hydraulic accumulator, and having a stop valve mounted between the operating cylinder and the accumulator. The stop valve has a controllable valve element which is switched to its transmission direction for damping the movement of the operating cylinder. A switching valve that may be controlled by the control block is connected to the feed line of the hydraulic accumulator. The switching valve, when not actuated, blocks the feed line and the stop valve being connected to a secondary branch line connected to the feed line. Accumulator pressure is applied to such stop valve in the direction of opening, and is removed from such valve in the direction of closing. The disclosed solution allows charging the accumulator, independently of actuation of the operating cylinder, by means of the mechanism of pressure equalization between accumulator pressure and piston pressure. The disclosed hydraulic circuit is, however, of complicated design and requires a large number of components, so that such system is cost-intensive.

SUMMARY OF THE INVENTION

Objects of the present invention are to provide an improved machine with a control device which provides increased security, which aids in preventing overloading of accumulators resulting from peak loads, in particular in the operation of applying a load to a machine, and which results in simplification of the hydraulic circuit.

These objects are basically attained by a machine where the piston space and the rod space of the operating cylinder are connected to the control block to effect conducting of fluid. The piston space communicates with the feed line to effect conducting of fluid. A switching valve is controlled by a control block and is connected to the feed line. This hydraulic circuit is appreciably simplified in comparison to similar conventional hydraulic circuits. In addition, the respective hydraulic accumulator may be charged by way of the feed line by the respective operating cylinder in raising of a load, so that the accumulator pressure then corresponds to the raising pressure under a load.

If the feed line is then blocked way of the stop valve controlled by the control block and the stop valve connected to the secondary branch line remains in the blocking position, the damping accumulator is separated from the operating cylinder. Pressure peaks which occur, for example, during work with the operating implement, such as a boom, loading shovel, or the like, do not have a damaging effect on the hydraulic accumulator. The stop valve is then switched to its transmission position to activate the suspension system, with the stop valve simultaneously blocked in the feed line. Since the load to be buffered is adapted to the earlier hoisting and feed pressure of the accumulator, upward extension of the operating cylinder may occur. Consequently, with the control device of the present invention, not only is the respective hydraulic damping accumulator protected from harmful peak loads, but security during operation of the machine is also increased.

Other objects, advantages and salient features of the present invention will become apparent from the following detailed description, which, taken in conjunction with the annexed drawings, discloses as preferred embodiment of the present invention.

BRIEF DESCRIPTION OF THE DRAWINGS

Referring to the drawings which form a part of this disclosure:

The sole FIGURE is a diagrammatic circuit diagram illustrating the essential primary components of a machine according to an embodiment of the present invention, not drawn to scale.

DETAILED DESCRIPTION OF THE INVENTION

The control device is provided in particular for use in machines such as wheeled loaders, excavators, and the like. To actuate and control a loading or excavating shovel, at least one hydraulic operating cylinder 10, is provided for raising and lowering a predetermined load 12 with a piston rod unit 14. The specific piston of this unit 14 subdivides the operating cylinder 10 into a piston space 16 and a rod space 18. Several operating cylinders (not shown) connected in parallel to each other may be provided, as a function of the configuration of the machine.

A conventional control block 20 usually provided for these tasks is used to drive the operating cylinder 10. The control block 20 to controls the pressure medium paths between the operating cylinder 10, a pressure medium supply P, and a tank T. The control device also has a hydraulic accumulator 22 which serves as damping accumulator. A plurality of accumulators can be employed as a function of the definition of the problem. The accumulator 22 is of conventional design, and is also referred to as a "hydraulic accumulator." A feed line 24, connected to the control block 20 with its pressure supply P, extends between operating cylinder 10 and accumulator 22. A first switching valve 26 and a non-return valve 28, which return valve is spring-loaded and opens in the direction of the accumulator 22, are also connected to or in the feed line 24.

In the circuit diagram, the first switching valve 26 is shown in its position blocking the feed line 24. A secondary branch line 30, provided with a stop valve 32, is also connected to the feed line 24. The stop valve 32 has a controllable valve element 34 which serves to connect the accumulator 22 for the purpose of damping the movement (cushioning) of the operating cylinder 10 and which may be switched to its transmission position for this purpose. However, as is indicated by the circuit diagram, the stop valve, when in its initial position shown, assumes its position blocking the secondary branch line 30.

Consequently, the switching valve 26 and the stop valve 32 are connected in parallel with each other in the feed line 24 and the secondary branch line 30, respectively. The two free ends of the secondary branch line 30 discharge, in the respective direction of the fluid flow upstream and downstream from the switching valve 26, into the feed line 24, at the connection points 36, 38.

Also as shown, the circuit diagram includes another or second switching valve 40, shown in the unactuated state. Switch valve 40 moves the valve element 34 of the stop valve 32 to its opening position when actuated, and is connected to the secondary branch line 30 between the accumulator 22 and the stop valve 32. When not actuated, the other switching valve 40 is connected to an oil leakage line L. The switching valve 40 may be controlled and operated in particular by the operator of the machine. If the switching valve 40 has been switched to its operating position, the accumulator pressure is conducted to the stop valve 32 of the part of the secondary branch line 30 connected to the accumulator 22 and moves this stop valve 32 to is transmission position. The other switching valve 40 is connected for this purpose to secondary branch line 30 of the connection point 42, between connection point 38 and the stop valve 32.

The rod space 18 of the operating cylinder 10 is connected by a connecting line 43 to the control block 20 and of another connecting line 44 to a third switching valve 46. The third switching valve 46 is connected to the tank T and, as the circuit diagram indicates, may also be actuated by way of a control line 48 and accordingly the second switching valve 40. The third switching valve 46 is moved by the control line 48 from its blocked position to its transmission position, such that the pressure in the rod space 18 in the direction of the tank T may be removed. In addition, a pressure control valve 50, otherwise connected to the accumulator 22 at the connection point 38, is connected to oil leakage line L. A manually actuatable stop device 52 is provided and extends in parallel with the pressure control valve.

The valve configuration referred to may be concentrated in one valve block 54. The operating cylinder 10, with connections A and B may be connected to this valve block 54. The accumulator 22 may be connected to the valve block 54 by the connection Sp. A control line of the control block 20 communicates with the valve block 54 by the connection VStö for actuation of the first switching valve 26. Connections T and L are also provided for connection of the tank and oil leakage line, respectively. The first switching valve 26, the third switching valve 46 and the stop valve 32 are each in the form of 2/2-way valves and, in their normal positions, are all connected for blocking. The second switching valve 40 is a 3/2-way valve which, when not operated, establishes a fluid conducting connection between the control line 48 and the oil leakage line L. Both the stop valve 32 and the third switching valve 56 must control large volume flows. The volume flow passing through the third switching valve 46 is smaller than that passing through the stop valve 32. This flow volume differential results from the third switching valve 46 being associated with the rod space 18 and the stop valve 32 being associated with the piston space 16. The change in the volume of those spaces results in different volume flows. In any event, when the operating cylinder 10 is introduced only a very small pressure difference, which may be lower than 1 bar, is available in the third switching valve 46.

For the sake of better understanding of the operation of the control device of an embodiment of the present invention, the operation of this device is now explained in detail. The suspension remains blocked for filling the loading shovel and its emptying if a boom is to be raised or lowered. For the purpose of moving the load 12 of the hydraulic operating cylinder 10, the control block 20 is actuated and the control fluid or flow of the switching valve (VStö) opens the first switching valve 26, so that fluid conduction is thus established by the opening of return valve 28. When the load 12 is raised, the accumulator 22 is charged by the return valve 28 with the maximum pressure occurring during the respective operating cycle, so that the raising pressure for the load 12 corresponds to the filling pressure of the accumulator 22.

The suspension may now be activated for traveling with the machine. The control block 20 is switched to its neutral (closed) position. The second switching valve 40 is now actuated. The accumulator pressure is applied to the two switching-operated valves 32 and 46 through the control line 48 causing the valves to open. The third switching valve 46 is actuated and connects the rod space 18 to the tank T. The stop valve 32 is additionally switched and connects the piston space 16 of the operating cylinder 10 to the accumulator 22, with the result that the suspension described is activated.

For the purpose of deactivating the suspension, the second switching valve 40 is actuated, so that the pilot control lines 48 of the valves 32 and 46 are connected to the tank line. The valves 32 and 46 consequently close, with the accumulator 22 remaining charged and the suspension being blocked. With the suspension blocked, the loading shovel may now be inserted into the loading material, such as that in the form of broken stones. The high pressures which may occur in the hoisting cylinders, are not being transmitted to the accumulator 22 and are not causing damage, since the first switching valve 26, in the form of a sliding valve, remains closed at this time and thus interrupts the fluid conducting connection through the feed line 24. Since the suspension strictly speaking is useful only in driving operation, in effect it is activated only for driving operation. The control device of the present invention ensures that the suspension is blocked if the accumulator 22 could be overloaded by pressure peaks when load is introduced or if the operating implement (loading shovel) actuated by the operating cylinder 10 comes to be in an operating condition, with or without load, in which an unintentional movement process (raising of a boom or the like) possibly resulting from connection of the accumulator 22 could become dangerous.

While one embodiment has been chosen to illustrate the invention, it will be understood by those skilled in the art that various changes and modification can be made therein without departing from the scope of the invention as defined in the appended claims.

What is claimed is:

1. A machine with a control device, comprising:

an operating implement;

at least one hydraulic operating cylinder for actuating said operating implement, said operating cylinder having a piston space and a rod space;

a control block for controlling flow of pressure medium between said piston space and said rod space of operating cylinder and a pressure supply and a tank;

at least one pressure accumulator connected in fluid communication to said operating cylinder by a feed line;

a fluid operated stop valve mounted in fluid communication between said operating cylinder and said accumulator, said stop valve being a 2/2-way valve having a controllable valve element movable to a transmission position connecting said operating cylinder and said accumulator for dampening movement of said operating cylinder;

a fluid operated first switching valve controlled by fluid pressure from said control block and connected to said feed line coupled to said accumulator, said first switching valve being a 2/2-way valve and blocking said feed line when said first switching valve is not actuated, said piston space being in fluid communication with said feed line; and a secondary branch line connecting said stop valve and said accumulator in fluid communication with said feed line, accumulator pressure being applied to said stop valve in a direction of opening and being removed from said stop valve in a direction of closing.

2. a machine according to claim 1, wherein said switching valve and said stop valve are connected in parallel with one another in said feed line and said secondary branch line, respectively; and said secondary branch line ends at said feed line at connection points upstream and downstream of said first switching valve in directions of fluid flow therethrough.

3. A machine according to claim 1 wherein a non-return valve is mounted in said feed line between said first switching valve and said accumulator, and opens in a direction of said accumulator.

4. A machine according to claim 1 wherein a fluid operated second switching valve is connected to said secondary branch line between said accumulator and said stop valve, said second switching valve conveying a control fluid pressure to said stop valve to move said valve element thereof to said transmission position when said switching valve is actuated.

5. A machine according to claim 1 wherein a fluid operated third switching valve is connected and controls fluid communication between said rod space of said operating cylinder and a tank.

6. A machine according to claim 5 wherein said third switching valve is connected to said stop valve for being switched simultaneously to transmission positions thereof.

7. A machine according to claim 1 wherein a pressure control valve is connected to said feed line and a tank line to protect said accumulator.

* * * * *